US011441518B2

(12) United States Patent
Grether et al.

(10) Patent No.: US 11,441,518 B2
(45) Date of Patent: Sep. 13, 2022

(54) CARBURETOR AND TWO-STROKE ENGINE WITH A CARBURETOR

(71) Applicant: Andreas Stihl AG & Co. KG, Waiblingen (DE)

(72) Inventors: Michael Grether, Waiblingen (DE); Bernd Engel, Stuttgart (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 0 days.

(21) Appl. No.: 17/377,095

(22) Filed: Jul. 15, 2021

(65) Prior Publication Data

US 2022/0025837 A1 Jan. 27, 2022

(30) Foreign Application Priority Data

Jul. 21, 2020 (DE) ..... 10 2020 119 158.8

(51) Int. Cl.

| | |
|---|---|
| ***F02M 35/08*** | (2006.01) |
| ***F02M 3/08*** | (2006.01) |
| ***F02M 35/10*** | (2006.01) |
| ***F02B 75/02*** | (2006.01) |

(52) U.S. Cl.

CPC ..... *F02M 3/08* (2013.01); *F02B 75/02* (2013.01); *F02M 35/10* (2013.01); *F02M 35/10242* (2013.01); *F02B 2075/025* (2013.01)

(58) Field of Classification Search

CPC .... F02M 3/08; F02M 35/10242; F02M 35/10; F02B 75/02; F02B 2075/025

See application file for complete search history.

(56) References Cited

U.S. PATENT DOCUMENTS

| | | | | |
|---|---|---|---|---|
| 4,487,185 | A | 12/1984 | Yokoyama et al. | |
| 4,500,478 | A | 2/1985 | Furukawa et al. | |
| 4,961,409 | A | 10/1990 | Kobayashi et al. | |
| 7,013,851 | B2 | 3/2006 | Prager | |
| 7,090,204 | B2 | 8/2006 | Zwimpfer et al. | |
| 7,258,327 | B2 | 8/2007 | Prager | |
| 7,494,113 | B2 * | 2/2009 | Eberhardt ..... | F02M 17/04 261/DIG. 1 |

(Continued)

FOREIGN PATENT DOCUMENTS

| | | |
|---|---|---|
| CN | 203335278 U | 12/2013 |
| CN | 206256977 U | 6/2017 |

(Continued)

*Primary Examiner* — Syed O Hasan

(74) *Attorney, Agent, or Firm* — Walter Ottesen, P.A.

(57) ABSTRACT

A carburetor has a carburetor body wherein an intake channel is formed. A throttle flap is pivotably mounted by a throttle shaft in the carburetor body for controlling the free flow cross-section of the intake channel. The intake channel has a first longitudinal center axis in the region of the throttle shaft. The throttle flap has first and second end positions, wherein the throttle flap opens a larger flow cross-section of the intake channel in the second end position than in the first end position. A partition wall section, on which the throttle flap lies in the second end position, is arranged upstream of the throttle shaft. A choke flap is upstream of the partition wall section and is pivotable between first and second end positions. In their second end positions, the throttle flap and the choke flap overlap in the direction of the first longitudinal center axis.

16 Claims, 4 Drawing Sheets

(56) References Cited

U.S. PATENT DOCUMENTS

| | | | | |
|---|---|---|---|---|
| 7,523,922 | B2 | 4/2009 | Shebuski | |
| 7,694,943 | B2 | 4/2010 | Mason et al. | |
| 7,730,857 | B2 | 6/2010 | Geyer et al. | |
| 7,828,272 | B2 | 11/2010 | Glover | |
| 8,667,933 | B2 | 3/2014 | Grether et al. | |
| 9,353,675 | B2 | 5/2016 | Grether et al. | |
| 9,988,971 | B2 | 6/2018 | Yamazaki et al. | |
| 2004/0051186 | A1* | 3/2004 | Gerhardy | F02D 9/1045 261/DIG. 52 |
| 2007/0257379 | A1* | 11/2007 | Mason | F02M 35/10196 261/38 |
| 2008/0302332 | A1 | 12/2008 | Dow et al. | |
| 2014/0261277 | A1* | 9/2014 | Volckart | F02M 35/10 123/184.21 |
| 2017/0058788 | A1 | 3/2017 | Tobinai | |

FOREIGN PATENT DOCUMENTS

| | | | |
|---|---|---|---|
| DE | 32 02 882 | A1 | 12/1982 |
| DE | 698 03 302 | T2 | 3/1993 |
| DE | 103 26 488 | A1 | 4/2004 |
| DE | 103 45 653 | A1 | 4/2005 |
| DE | 10 2004 009 310 | A1 | 9/2005 |
| DE | 10 2005 003 559 | A1 | 8/2006 |
| DE | 10 2006 024 078 | A1 | 11/2007 |
| DE | 10 2006 024 079 | A1 | 11/2007 |
| DE | 10 2006 032 475 | A1 | 1/2008 |
| DE | 10 2010 054 838 | A1 | 6/2012 |
| DE | 10 2010 054 839 | A1 | 6/2012 |
| DE | 103 62 372 | B3 | 2/2016 |
| DE | 10 2006 063 035 | B3 | 12/2017 |
| EP | 1 740 819 | B1 | 6/2008 |
| JP | 2006-328983 | A | 12/2006 |

* cited by examiner

CARBURETOR AND TWO-STROKE ENGINE WITH A CARBURETOR

CROSS REFERENCE TO RELATED APPLICATION

This application claims priority of German patent application no. 10 2020 119 158.8, filed Jul. 21, 2020, the entire content of which is incorporated herein by reference.

TECHNICAL FIELD

The disclosure is directed to a carburetor and a two-stroke engine with a carburetor.

BACKGROUND

US 2007/0257379 A1 discloses a carburetor which has a throttle flap and a choke flap for controlling the flow cross-section of the intake channel. A partition wall section is arranged between the throttle shaft and the choke shaft and separates an air channel from a mixture channel in the carburetor.

Such carburetors may be used for two-stroke engines in hand-guided working devices, such as for example motorized saws, brush cutters, hedge cutters, angle grinders, blowers or similar. For such working devices, a minimum weight and minimum size are desirable in order to allow ergonomic working. At the same time, the two-stroke engine must have a constant running behavior even during pivoting of the working device during operation.

SUMMARY

An object of the invention is to provide a carburetor, which has a low weight and small size, with good running performance of a two-stroke engine operated with the carburetor. A further object of the invention is to provide a two-stroke engine with a carburetor having good running performance and small size.

The throttle flap and the choke flap of the carburetor each have a first end position and a second end position. The flow cross-section of the intake channel section opened by the throttle flap or choke flap is larger in the respective second end positions of the throttle flap and choke flap than in their respective first end positions. A partition wall section is arranged in the intake channel section upstream of the throttle shaft, and divides the intake channel section into a mixture channel section and an air channel section. In their two end positions, the throttle flap and choke flap overlap in the direction of the first longitudinal center axis of the intake channel section. In this way, the distance between the rotational axes of the throttle flap and choke flap may be reduced. This leads to a reduced installation length of the carburetor body and hence also to a lower weight of the carburetor. The partition wall section arranged between the throttle flap and choke flap allows a desired separation to be achieved between the intake channel section and the air channel section. Depending on the configuration of the partition wall section, when the throttle flap is partially opened, a pressure balance is possible or a transfer of mixture from the mixture channel section into the air channel section. If the partition wall section extends up to the throttle shaft, a substantial or complete separation of the air channel section and mixture channel section in the carburetor can be achieved.

In the region in which the throttle flap and choke flap overlap, because the throttle flap and choke flap bear on the partition wall section, the partition wall section is arranged between the throttle flap and choke flap. Accordingly, in the second end position of the throttle flap and choke flap, the throttle flap, choke flap and partition wall section are arranged in one length section of the carburetor. In this region, this leads to a comparatively great thickness of the arrangement between the air channel section and mixture channel section. It has however been found that, because of the usual dimensions of the choke shaft, this region lies largely or completely in the lee of the choke shaft, and therefore the flow properties in the carburetor and hence also the air quantity and mixture quantity conducted to a combustion engine, and the mixture composition, are only slightly influenced. Thus a desired running behavior can be achieved with reduced dimensions and reduced weight of the carburetor.

Advantageously, the ratio of the length of the carburetor body, measured in the direction of the first longitudinal center axis, to the diameter of the throttle flap is at most 1.5. Advantageously, a ratio of maximum 1.4 is provided, particularly preferably a ratio of maximum 1.3. This gives a comparatively short length of the carburetor body in relation to the diameter of the throttle flap, which also determines the size of the intake channel section in the region of the throttle flap. The length section of the carburetor, in which both the throttle flap and the choke flap extend in their second end positions, advantageously has a length measured parallel to the first longitudinal center axis which is at least 10%, in particular at least 15%, of the diameter of the throttle flap. The comparatively large length of the length section in which both the throttle flap and choke flap extend, and in which the choke flap and throttle flap thus overlap in their second end positions in the direction of the first longitudinal center axis of the intake channel section, allows a short length of the carburetor body. Thus, advantageously, both the throttle flap and choke flap are mounted in the carburetor body.

Advantageously, in its second end position, the choke flap bears on the partition wall section. In this way, the thickness of the region between the air channel section and the mixture channel section can be reduced in the second end positions of the throttle flap and choke flap, so that even on full load, there is a sufficiently large air throughflow for the two-stroke engine. Thus the diameter of the intake channel section can be kept comparatively small, leading to a small installation size of the carburetor. It may however also be provided that, in its second end position, the choke flap does not bear on the partition wall section. The second end position of the choke flap in this case may be established in particular by other means, for example by a stop.

In order to influence the flow as little as possible, it is provided that in its second end position, the throttle flap is concealed by the choke shaft in a projection in the direction of the first longitudinal center axis, viewed from the choke shaft towards the throttle shaft, when the choke flap is in its second end position. The throttle flap then does not protrude beyond a corridor which lies behind the choke shaft in the flow direction. The throttle flap thus lies in the lee of the choke shaft and at most only slightly influences the flow in the intake channel section. The intake channel section has a second longitudinal center axis of the intake channel section in the region of the choke shaft.

It may be provided that in their second end positions, the throttle flap and choke flap run parallel to the first longitudinal center axis. In an advantageous alternative embodiment, it is provided that in its second end position, the choke flap is tilted with respect to the first longitudinal center axis by an angle of at least 2°. The partition wall section can be configured such that the partition wall section is concealed or hidden by the choke shaft in a projection in the direction of the longitudinal center axis, viewed from the choke shaft to the throttle shaft. The partition wall section thus has little or no influence on the flow at full load, that is, when the choke flap and throttle flap are in their second end positions.

In its second end position, the throttle flap is preferably concealed by the choke shaft in a projection in the direction of the first longitudinal center axis, viewed from the choke shaft to the throttle shaft. The throttle flap advantageously lies in the lee of the choke shaft. At least the portion of the throttle flap lying downstream of the throttle shaft, with respect to the flow direction from the choke shaft to the throttle shaft, advantageously does not, in its second end position, protrude beyond the throttle shaft in the direction of the first longitudinal center axis. The portion of the throttle flap thus lies in the lee of the throttle shaft. In this way, the flow in the intake channel section is not reduced or only slightly reduced by the throttle flap in its second end position.

In its second end position, the throttle flap may run parallel to the first longitudinal center axis. In an alternative advantageous embodiment, it is provided that in its second end position, the throttle flap is tilted with respect to the first longitudinal center axis by an angle of at least 2°. Thus both the throttle flap and the choke flap are tilted by at least 2° with respect to the first longitudinal center axis, that is, with sufficient thickness of the partition wall section, a comparatively large overlap of the throttle flap and choke flap may be achieved, so that the installation size of the carburetor as a whole may be reduced further.

Preferably, the first longitudinal center axis runs through the partition wall section. The first longitudinal center axis thus intersects the partition wall section. Advantageously, a main fuel opening opens into the mixture channel section upstream of the throttle shaft.

An independent inventive concept concerns a carburetor in which the first longitudinal center axis of the intake channel section and a second longitudinal center axis of the intake channel section have an offset to one another measured parallel to the pivot axis of the throttle flap in the region of the choke shaft. This allows a compact arrangement and small structure of the carburetor.

An offset of the first and second longitudinal center axes measured parallel to the pivot axis of the throttle flap is particularly advantageous if different flow cross-sections of the intake channel section are provided in the region of the choke shaft and in the region of the throttle shaft. Advantageously, the throttle flap and choke flap have a circular form, and the intake channel section in the region of the choke shaft and the intake channel section in the region of the throttle shaft have a circular cross-section. The offset of the first longitudinal center axis and the second longitudinal center axis preferably amounts to at least one millimeter. Alternatively or additionally, it may be provided that the pivot axes of the throttle flap and choke shaft have a height offset in a direction perpendicular to the first longitudinal center axis and perpendicular to the pivot axis of the throttle shaft. Preferably, the throttle shaft and choke shaft lie parallel to one another so that the pivot axes of the throttle flap and choke flap run parallel to one another.

For a two-stroke engine with a carburetor according to the disclosure, it is advantageously provided that the intake channel section of the carburetor forms a section of an intake channel of the two-stroke engine, wherein the intake channel is divided downstream of the carburetor into a mixture channel and an air channel. The mixture channel section of the carburetor here advantageously adjoins a mixture channel, and the air channel section of the carburetor adjoins an air channel. The two-stroke engine advantageously has a cylinder in which a combustion chamber is formed, wherein the combustion chamber is delimited by a piston mounted in the cylinder so as to be movable to and fro. The piston drives in rotation a crankshaft mounted in a crankcase. The mixture channel opens via a mixture inlet into a crankcase interior of the crankcase, and the air channel can be connected to at least one transfer channel of the two-stroke engine.

BRIEF DESCRIPTION OF THE DRAWINGS

The invention will now be described with reference to the drawings wherein.

DESCRIPTION OF THE PREFERRED EMBODIMENTS

Figure 1:
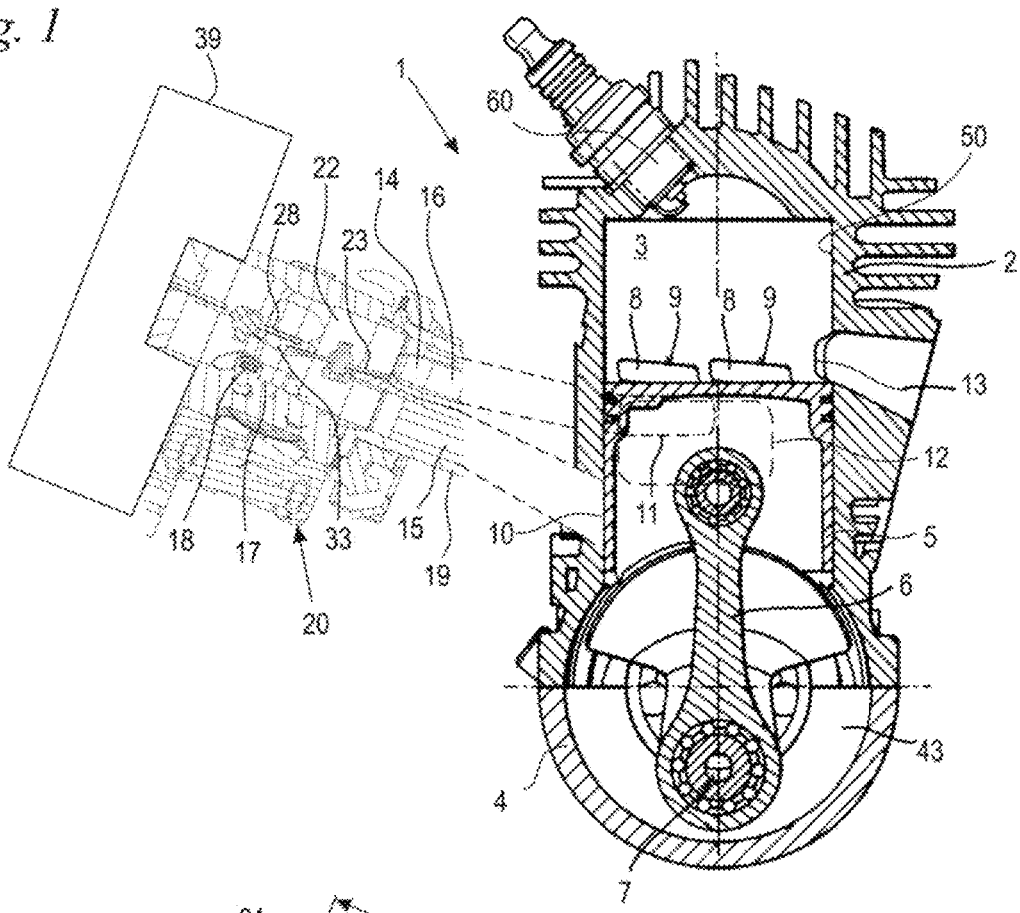
FIG. 1 is a schematic section view through a two-stroke engine.

FIG. 1 shows a two-stroke engine 1 which may be used for example for hand-guided work apparatuses such as motorized saws, angle grinders, brushcutters, hedge cutters, blowers or similar. The two-stroke engine 1 is a scavenging engine. The two-stroke engine 1 is a single cylinder engine. The two-stroke engine 1 has a cylinder 2 in which a combustion chamber 3 is formed. The combustion chamber 3 is delimited by a piston 5, indicated schematically with dotted lines in FIG. 1, which is mounted in the cylinder 2 so as to be movable to and fro. Via a connecting rod 6, the piston 5 drives a crankshaft 7 which is mounted rotatably in a crankcase 4. The crankshaft 7 serves to drive a tool of the work apparatus.

Transfer channels 8 are formed in the cylinder 2 and open into the combustion chamber 3 via transfer windows 9. In the region of the bottom dead center of the piston 5, the transfer channels 8 connect a crankcase interior 43 of the crankcase 4 to the combustion chamber 3. A mixture inlet 10 controlled by the piston 5 opens into the cylinder 2. Also, at least one air inlet 11 controlled by the piston 5 opens into the cylinder 2. The piston 5 has at least one piston pocket 12. The piston pocket 12 is shown in dotted lines in FIG. 1. The at least one piston pocket 12 fluidically connects the at least one air inlet 11 to the at least one transfer window 9 in the region of the top dead center of the piston 5. In this way, air from an air channel 16 may be stored in the transfer channels 8. In the embodiment, two air inlets 11 are provided, which are advantageously arranged symmetrically with respect to the sectional plane of FIG. 1 and are each to be connected to two transfer channels 8. The air channel 16 opens at the at least one air inlet 11 on the cylinder bore 50 of the cylinder 2. An outlet 13 controlled by the piston 5 leads from the combustion chamber 3.

The two-stroke engine 1 has an intake channel 14 via which air and fuel are supplied to the two-stroke engine 1 during operation. The intake channel 14 is divided into a mixture channel 15 and an air channel 16. The air channel 16 opens at the at least one air inlet 11 on the cylinder bore 50. The mixture channel 15 opens at the mixture inlet 10 on the cylinder bore 50. Fuel is supplied in a carburetor 20. A main fuel opening 18 opens into the mixture channel 15 in the carburetor 20. Fuel is supplied to the mixture channel 15 via the main fuel opening 18. Further secondary fuel openings may be provided which open into the mixture channel. The main fuel opening 18 is advantageously arranged in the region of a venturi 17, which is formed in the carburetor 20.

In the embodiment, the carburetor 20 is connected to the cylinder 2 via a connecting piece 19. The connecting piece 19 is preferably an elastic connecting piece so that relative movements between different assemblies of a hand-guided work apparatus can be compensated by the elastic connecting piece 19. An air filter 39 is arranged upstream of the carburetor 20, via which air is drawn into the intake channel 14 during operation.

During operation, on the upward stroke of the piston 5, a fuel/air mixture is drawn into the crankcase interior 43 via the mixture channel 15. As soon as the piston pockets 12 connect the at least one air inlet 11 to the at least one transfer window 9, air from the air channel 16 is stored in the transfer channels 8. On the downward stroke of the piston 5, the fuel mixture in the crankcase interior 43 is compressed. As soon as the transfer windows 9 open to the combustion chamber 3, firstly the air stored in the transfer channels 8 flows into the combustion chamber 3 and flushes out exhaust gases from the preceding engine cycle through the outlet 13. Then the fuel/air mixture flows from the crankcase interior 43 via the transfer channels 8 into the combustion chamber 3. On the upward stroke of the piston 5, the mixture in the combustion chamber 3 is compressed and ignited by a spark plug 60 in the region of the top dead center of the piston 5. This accelerates the piston 5 in the direction towards the crankcase 4. As soon as the outlet 13 is opened by the piston 5, exhaust gases flow out from the combustion chamber 3 through the outlet 13. As soon as the transfer windows 9 are opened, any exhaust gases remaining in the combustion chamber 3 are flushed out through the outlet 13. Then fresh fuel/air mixture flows into the combustion chamber 3 from the crankcase interior 43.

Figure 2:
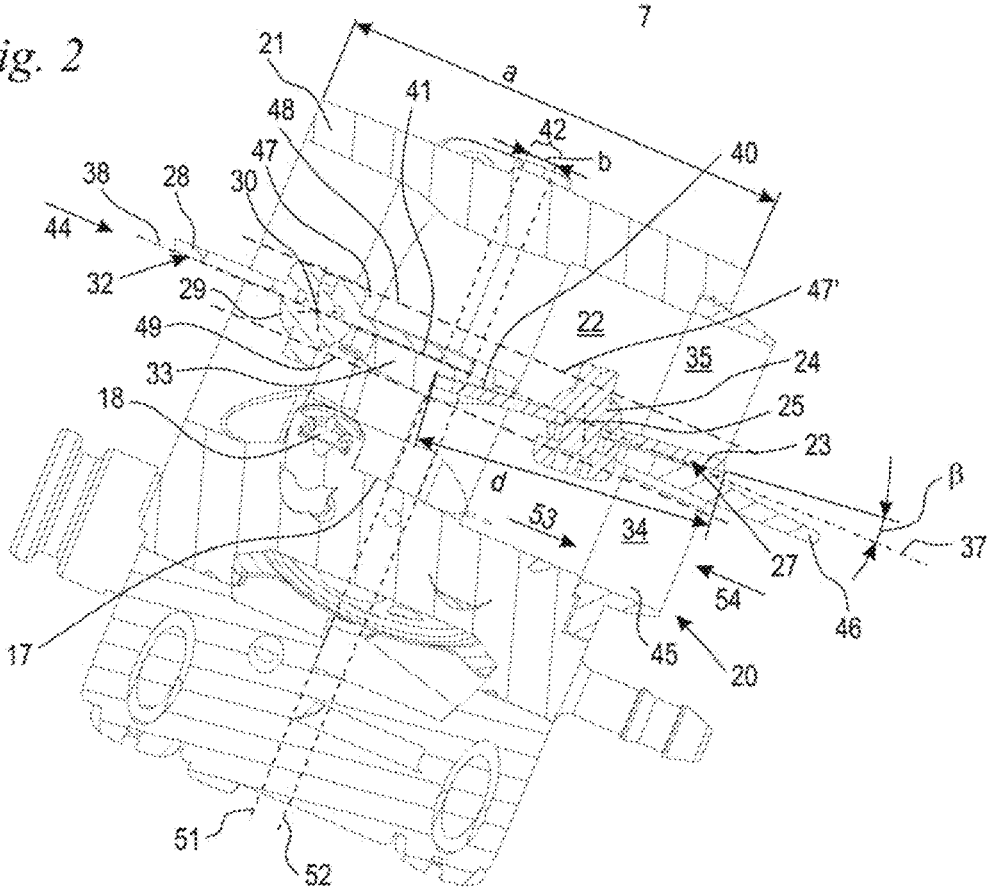
FIG. 2 shows the carburetor of the two-stroke engine from FIG. 1 in an enlarged section view, wherein the throttle flap and choke flap are in their second end positions.

As FIG. 2 shows, the carburetor 20 has a carburetor body 21 in which an intake channel section 22 is formed as a continuous opening. A throttle flap 23 is mounted by a throttle shaft 24 in the carburetor body 21 so as to be pivotable about a pivot axis 25. Also, a choke flap 28 is mounted by a choke shaft 29 in the carburetor body 21 so as to be pivotable about a pivot axis 30. FIG. 2 shows the throttle flap 23 in a second end position 27 in which the throttle flap 23 is completely opened. The choke flap 28 is also shown in a second end position 32 in which the choke flap 28 is fully opened. A partition wall section 33 is arranged upstream of the throttle shaft 24 in the region between the throttle shaft 24 and the choke shaft 29. The partition wall section 33 divides the intake channel section 22 into a mixture channel section 34 and an air channel section 35. The mixture channel section 34 forms a section of the mixture channel 15 of the two-stroke engine 1. The air channel section 35 forms a section of the air channel 16 of the two-stroke engine 1.

In the embodiment, a second partition wall section 46 is arranged downstream of the throttle shaft 24 and separates the mixture channel section 34 and air channel section 35, or mixture channel 15 and air channel 16, from one another downstream of the carburetor 20. The main fuel opening 18, as shown in FIG. 2, is arranged upstream of the throttle shaft 24 in the region of the venturi 17.

In the embodiment, the second partition wall section 46 is formed on a ring 45 which is inserted and preferably pressed into the carburetor body 21. The second partition wall section 46 may be configured integrally with the ring 45. In its second end position 27, the throttle flap 23 advantageously bears on the partition wall section 33. The throttle flap 23 may also bear on the second partition wall section 46 in its second end position 27.

In an alternative embodiment, in its second end position 27, the throttle flap 23 does not bear on the partition wall section 33 and/or the partition wall section 46. In this configuration, the throttle flap 23 may advantageously be positioned by other means, such as for example a stop.

In its second end position 32 shown in FIG. 2, the choke flap 28 advantageously bears on the partition wall section 33. The second end position 32 is here the position in which the throttle flap 23 or choke flap 28 causes least reduction of the flow cross-section in the intake channel section 22. In its second end position 32, alternatively the choke flap 28 may be positioned in another fashion, for example via at least one stop.

In the region of the throttle shaft 24, the intake channel section 22 has a first longitudinal center axis 37. In the region of the choke shaft 29, the intake channel section 22 has a second longitudinal center axis 38. The first longitudinal center axis 37 and the second longitudinal center axis 38 may, as shown, coincide in a sectional view perpendicularly to the pivot axis 25 of the choke shaft 24.

As FIG. 2 shows, in their second end positions 27, 32, the throttle flap 23 and choke flap 28 overlap in the direction of the longitudinal center axis 37 of the intake channel section 22. The carburetor 20 has a length section 42 in which both the choke flap 28 and the throttle flap 23 and also the partition wall section 33 extend. A length section 42 of the carburetor 20 is a section delimited by planes 51, 52 which extend perpendicularly to the first longitudinal center axis 37. The length section 42 is accordingly a theoretical slice of the carburetor 20, through which the intake channel section 22 passes. The length section 42 has a length b measured parallel to the first longitudinal center axis 37. The length b advantageously amounts to at least 5%, in particular at least 10%, preferably at least 15% of the diameter d of the throttle flap 23. A significantly shorter length b may however be advantageous in particular for a smaller diameter d of the throttle flap 23. Because of the overlap of the throttle flap 23 and choke flap 28, the carburetor 20 may be configured with a comparatively short length a. The length a here is the length of the carburetor body 21 in the direction of the first longitudinal center axis 37. The length a advantageously amounts to at most 1.5 times the diameter d of the throttle flap 23. A greater ratio of length a to diameter d may however also be advantageous.

Air and fuel flow in the intake channel section 22 in a flow direction 53 directed from the choke shaft 29 to the throttle shaft 24. In its second end position 27, the throttle flap 23 is concealed by the choke shaft 29 in a projection in the direction of the first longitudinal center axis 37, viewed from the choke shaft 29 to the throttle shaft 24, when the choke flap 28 is in its second end position 32. The throttle flap 23 accordingly stands in the lee of the choke shaft 29. Advantageously, at least the portion of the throttle flap 23 lying downstream of the throttle shaft 24 in the flow direction 53 is concealed by the throttle shaft 24, viewed in the flow direction 53. This portion of the throttle flap 23 advantageously lies in the lee of the throttle shaft 24. FIG. 2 shows in dotted lines a corridor 47 which is delimited by a first delimiting line 48 and a second delimiting line 49, each of which is shown in dotted lines. The distance between the delimiting lines 48 and 49 corresponds to the diameter of the choke shaft 29. As FIG. 2 shows, in its second end position 27, the throttle shaft 23 lies completely inside the corridor 47. The partition wall section 33 also lies in the corridor 47 and hence in the lee of the choke shaft 29.

In a second projection direction 54 which lies opposite the projection direction 44, the choke flap 28 is concealed by the throttle shaft 24. In the second projection 54, the lee is formed by the throttle shaft 24. The throttle shaft 24 forms a corridor 47'. In the arrangement shown in FIG. 2, the choke flap 28 does not protrude beyond the corridor 47'. In the embodiment, the choke flap 28 lies parallel to the longitudinal center axes 37 and 38, and in the immediate vicinity of the longitudinal center axes 37 and 38. Also, in its second end position 32, the choke flap 28 therefore has little or no influence on the flow in the intake channel section 22. The portion of the throttle flap 23 lying upstream of the throttle shaft 24 in the second projection direction 54 is concealed or hidden by the throttle shaft 24 and lies completely in the corridor 47'.

In the embodiment, the corridors 47 and 47' coincide. It may however also be provided that the corridors 47 and 47' only partially overlap.

In the embodiment, in its second end position 27, the throttle flap 23 is tilted with respect to the first longitudinal center axis 37. The angle β by which the throttle flap 23 is tilted with respect to the first longitudinal axis 37 preferably amounts to at least 2°. This allows a compact structure of the carburetor 20 with sufficient thickness of the partition wall section 33.

As FIG. 2 also shows, in its second end position 27, the throttle flap 23 lies in a first recess 40 of the partition wall section 33. The first recess 40 is sufficiently deep for the portion of the periphery of the throttle flap 23 facing the choke flap 28 to advantageously lie completely in the first recess 40, perpendicularly to the pivot axes 25 and 30 in the sectional illustration depicted. In its second end position 32, the choke flap 28 lies in a second recess 41 of the partition wall section 33. The periphery of the choke flap 28 also does not protrude out of the second recess 41 on its side facing the throttle flap 23, downstream of the choke shaft 29. The first longitudinal center axis 37 intersects the partition wall section 33, as shown in FIG. 2.

Figure 3:
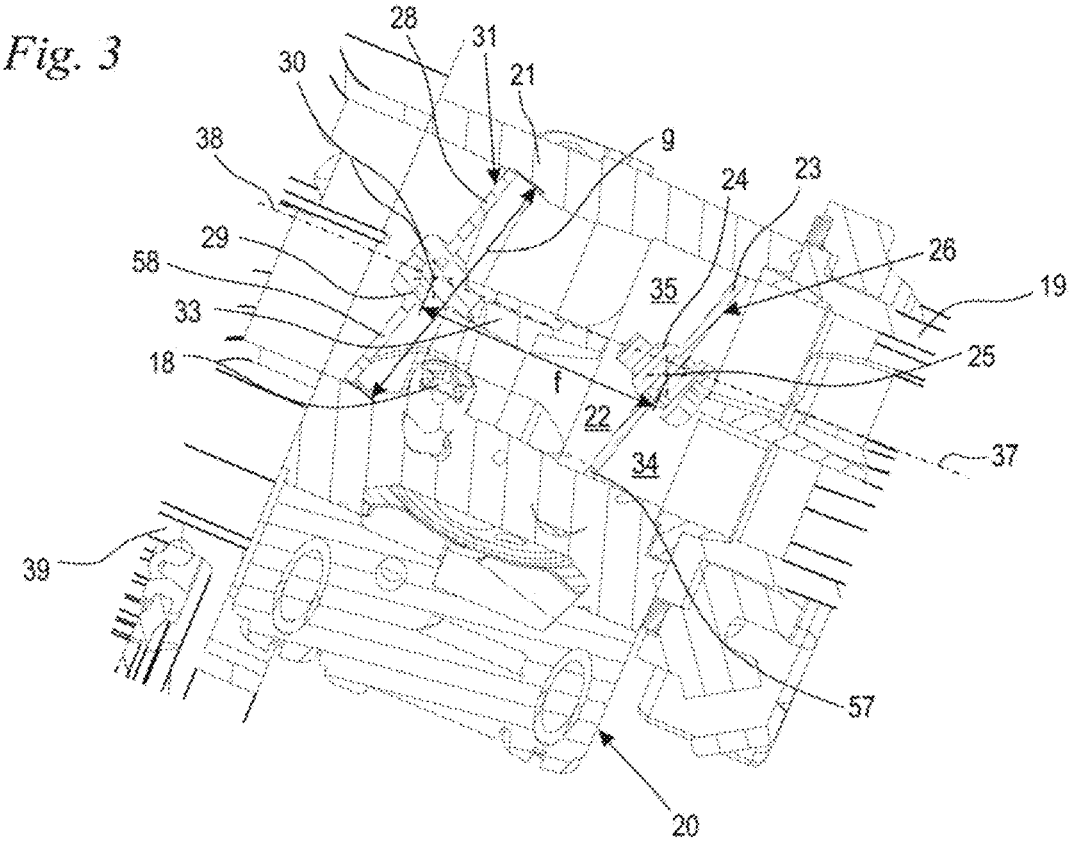
FIG. 3 is a section view of the carburetor from FIG. 2 with air filter and connecting piece shown in extract, wherein the throttle flap and choke flap are in their first end positions.

FIG. 3 shows the arrangement from FIG. 1 in extract, with the throttle flap 23 in its first end position 26 and the choke flap 28 in its first end position 31. The air filter 39 and the connecting piece 19 are only shown partially. In the first end position 26, the throttle flap 23 closes the intake channel section 22 except for a residual cross-section. Also, when it is in its first end position 31, the choke flap 28 closes the intake channel section 22 except for a residual cross-section. The residual cross-sections are determined by an opening 57 in the throttle flap 23 and an opening 58 in the choke flap 28. The peripheries of the flaps preferably bear on the channel wall of the intake channel section 22. The free flow cross-section in the first end positions 26 and 31 is significantly smaller than in the second end positions 27 and 32.

As FIG. 3 shows, the pivot axes 30 and 25 of the choke shaft 29 and throttle shaft 24 have a spacing f measured in the direction of the first longitudinal center axis 37. The spacing f is smaller than the sum of half a diameter g of the choke flap 28 and half the diameter d of the throttle flap 23. This leads to the overlap of the throttle flap 23 and choke flap 28 in their second end positions 27 and 32, as shown in FIG. 2.

Figure 4:
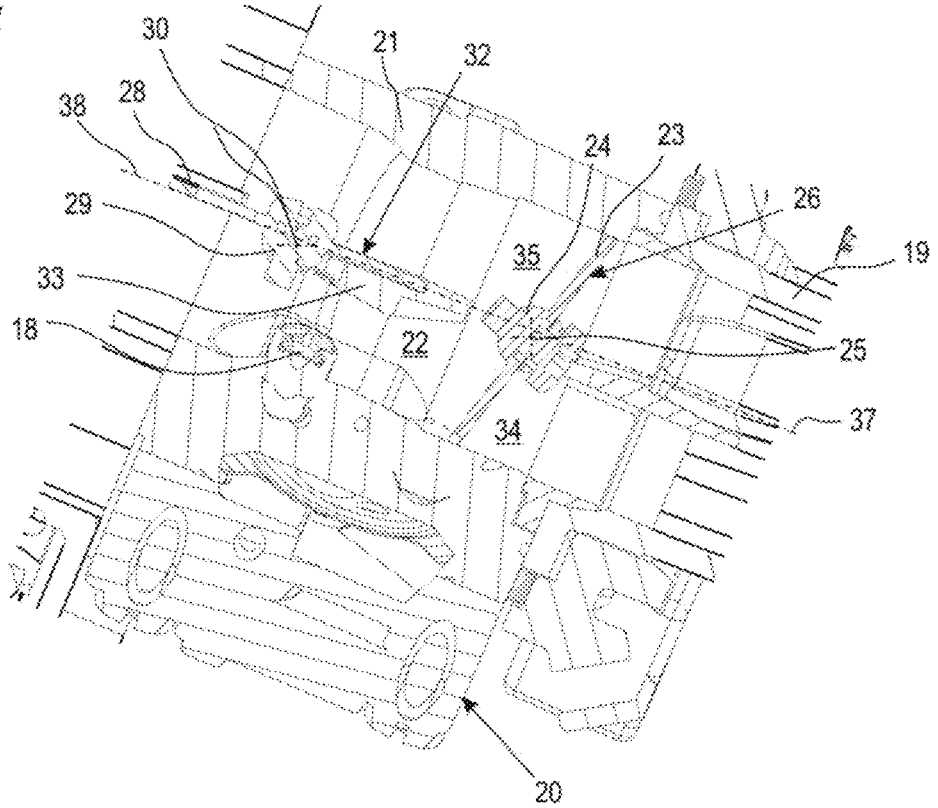
FIG. 4 is a schematic, in section, corresponding to FIG. 3, wherein the choke flap is in its second end position and the throttle flap in its first end position.

FIG. 4 shows the choke flap 28 in its second end position 32, and the throttle flap 23 in its first end position 26. These flap positions are usually assigned to idling mode.

Figure 5:
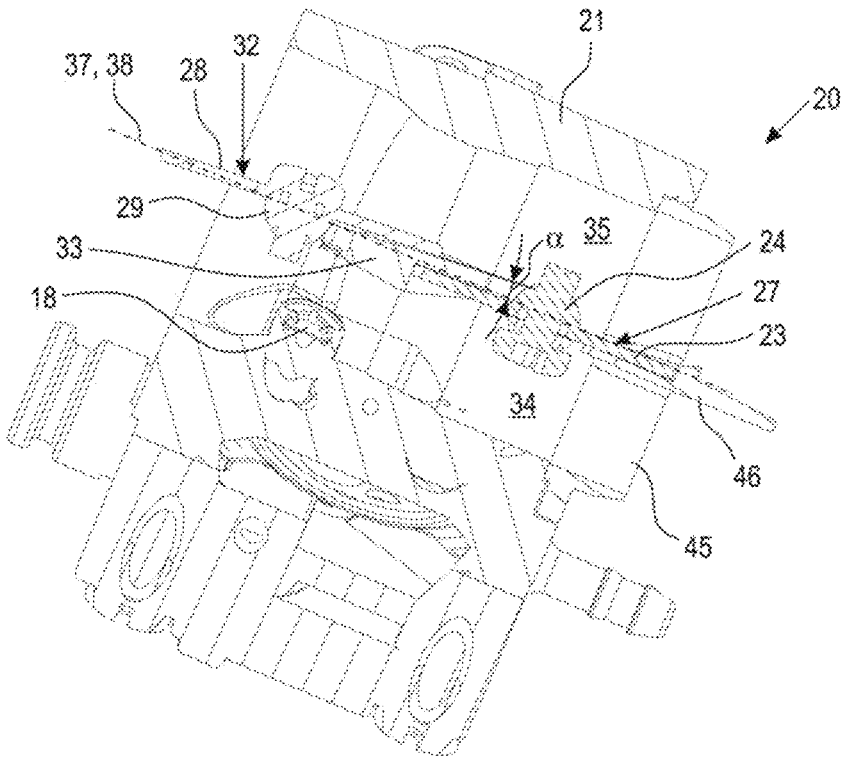
FIGS. 5 to 7 are section views through further embodiments of carburetors, wherein the throttle flap and choke flap are in their second end positions; and, FIG. 8 is a schematic of a section through a further embodiment of a carburetor in which the first and second longitudinal center axes have an offset to one another.

FIG. 5 shows an embodiment of a carburetor 20. The same reference signs designate corresponding elements in all figures. For the elements not described again in detail below, reference is made to the description of the preceding figures. The carburetor 20 has a choke flap 28 which, in the second end position 32 shown in FIG. 5, is tilted by an angle α relative to the first longitudinal center axis 37. The angle α advantageously amounts to at least 2°. In one embodiment, in the second end position 32, the choke flap 28 bears on the partition wall section 33. In an alternative configuration, in its second end position 32, the position of the choke flap 28 may also be established by other means, for example by a stop. The first longitudinal center axis 37 and the second longitudinal center axis 38 coincide in the sectional view illustrated. In its second end position 27 shown, the throttle flap 23 runs parallel to the first longitudinal center axis 37 and bears on both the partition wall section 33 and the partition wall section 46.

Figure 6:
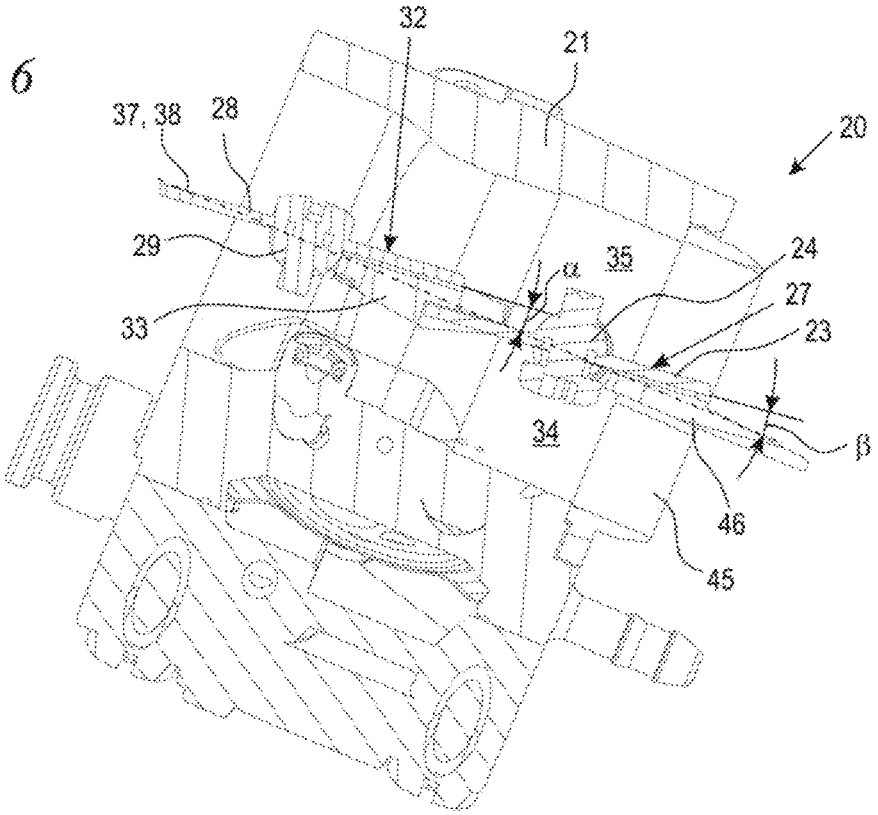

In the embodiment shown in FIG. 6, in its second end position 32, the choke flap 28 is tilted with respect to the first longitudinal center axis 37. The angle α which the choke flap 28 encloses with the first longitudinal center axis 37 is at least 2°. In its second end position 27, the throttle flap 23 is tilted by an angle β of at least 2° with respect to the first longitudinal center axis 37. The choke flap 28 and the throttle flap 23 bear on the partition wall section 33. The throttle flap 23 may also bear on the second partition wall section 46.

Figure 7:
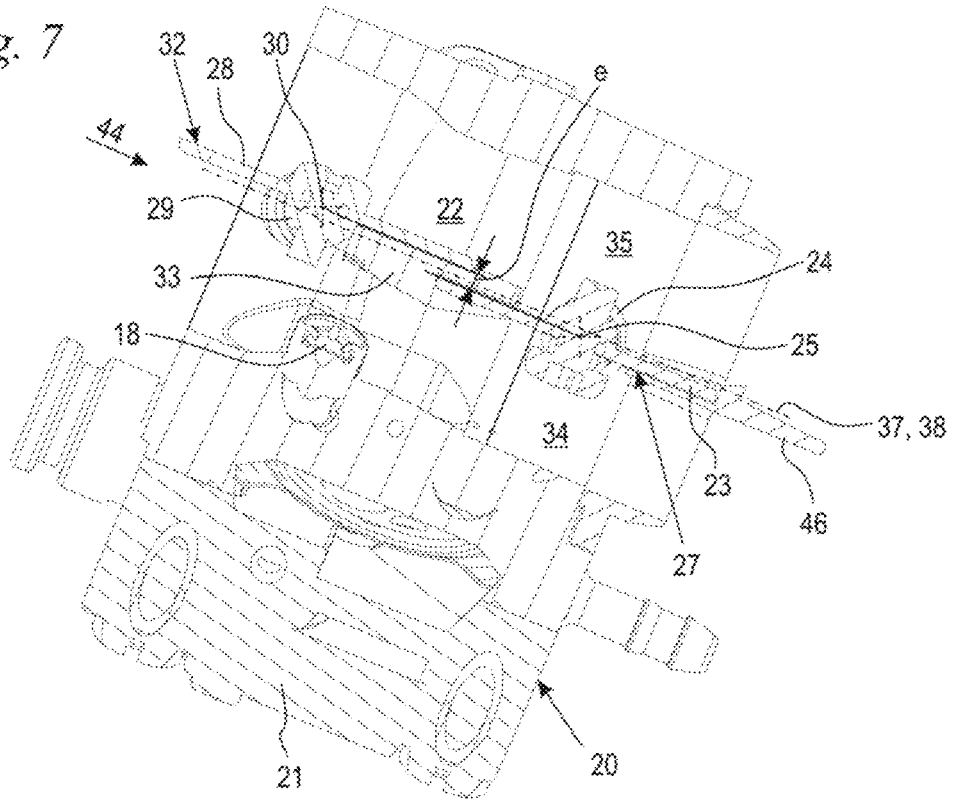

In the embodiment shown in FIG. 7, in the two end positions 27, 32, the throttle flap 23 and choke flap 28 run parallel to one another and parallel to the longitudinal center axes 37 and 38. Advantageously, the choke flap bears on the partition wall section 33, and advantageously the throttle flap bears on both the partition wall section 33 and also the partition wall section 46. The pivot axes 25 and 30 point in the direction perpendicular to the longitudinal center axis 37, and have a height offset e to one another measured perpendicularly to the pivot axes 25 and 30. In the projection direction 44, the pivot axes 30 and 25 accordingly do not lie one above the other but at a distance from one another which corresponds to the height offset e.

Figure 8:
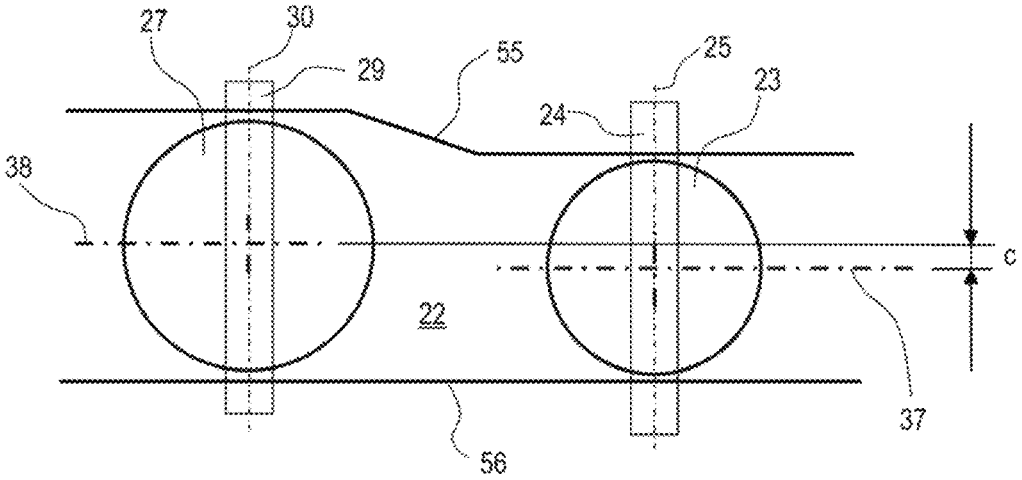

FIG. 8 shows schematically an arrangement of the longitudinal center axes 37 and 38 which may be advantageous for all embodiments described above. The longitudinal center axes 37 and 38 have an offset c relative to one another. The offset c is measured parallel to the pivot axes 25 and 30 and perpendicularly to the first longitudinal center axis 37. The offset c preferably amounts to at least one millimeter. The throttle flap 23 and choke flap 28 are advantageously circular. Because of the offset c of the longitudinal center axes 37 and 38, the side walls 55 and 56 of the intake channel section 22 are not configured mirror-symmetrically to one another in the sectional plane depicted schematically in FIG. 8. In the embodiment, the side wall 56 runs straight and the side wall 55 is kinked. The venturi portion is not shown in FIG. 8. FIG. 8 shows a cross-section in a section plane which contains at least the pivot axis 25 of the throttle flap 23, and runs parallel to the pivot axis 30 or also contains the pivot axis 30. The offset c forms an independent inventive concept which may be advantageous independently of the overlap of the throttle flap 23 and choke flap 28.

It is understood that the foregoing description is that of the preferred embodiments of the invention and that various changes and modifications may be made thereto without departing from the spirit and scope of the invention as defined in the appended claims.

What is claimed is:

1. A carburetor comprising:

a carburetor body having an intake channel formed therein;

said intake channel defining a free flow cross section;

a throttle flap having a throttle shaft and being pivotally mounted in said carburetor body for controlling said free flow cross section of said intake channel;

said intake channel defining a first longitudinal center axis in the region of said throttle shaft;

said throttle flap having a first end position and a second end position wherein said throttle flap enables a larger flow cross section of said intake channel than in said first end position;

a partition wall section mounted in said intake channel upstream of said throttle shaft;

said partition wall section being configured to partition said intake channel into a mixture channel section and an air channel section;

said throttle flap being configured to lie on said partition wall section when in said second end position thereof;

a choke flap mounted in said intake channel upstream of said partition wall section so as to be pivotal between a first end position and a second end position wherein said choke flap enables a greater flow cross section than in said first end position; and, said throttle flap and said choke flap being mounted so as to mutually overlap in the direction of said first longitudinal center axis when in said respective second end positions thereof.

2. The carburetor of claim 1, wherein:

said carburetor body has a length (a) measured in the direction of said first longitudinal center axis;

said throttle flap has a diameter (d); and, a ratio of said length (a) to said diameter (d) is at most 1.5.

3. The carburetor of claim 1, wherein:

said carburetor has a length segment wherein to said throttle flap and said choke flap both extend when in said respective second end positions thereof;

said length segment has a length (b) measured parallel to said first longitudinal center axis;

said throttle flap has a diameter (d); and, said length (b) is at least 10% of said diameter (d) of said throttle flap.

4. The carburetor of claim 1, wherein:

said carburetor has a length segment wherein to said throttle flap and said choke flap both extend when in said respective second end positions thereof;

said length segment has a length (b) measured parallel to said first longitudinal center axis;

said throttle flap has a diameter (d); and, said length (b) is at least 15% of said diameter (d) of said throttle flap.

5. The carburetor of claim 1, wherein said choke flap lies on said partition wall section when in said second end position thereof.

6. The carburetor of claim 1, wherein said throttle flap when in said second end position thereof is hidden by said choke flap in a projection in the direction of said first longitudinal center axis, viewed from said choke shaft to said throttle shaft, when said choke flap is in said second end position thereof.

7. The carburetor of claim 1, wherein said choke flap, in said second end position thereof, is inclined at an angle ($\alpha$) with respect to said first longitudinal center axis of at least 2°.

8. The carburetor of claim 1, wherein the partition wall section is hidden by said choke shaft in a projection in the direction of said first longitudinal center axis viewed from said choke shaft to said throttle shaft.

9. The carburetor of claim 1, wherein said throttle flap, in said second end position thereof, is hidden by said choke shaft in a projection in the direction of said first longitudinal center axis viewed from said choke shaft to said throttle shaft.

10. The carburetor of claim 1, wherein said throttle flap, in said second end position thereof, is inclined at an angle ($\beta$) with respect to the first longitudinal center axis of at least 2°.

11. The carburetor of claim 1, wherein said first longitudinal center axis runs through said partition wall section.

12. The carburetor of claim 1, further comprising a main fuel opening which opens into said mixture channel section upstream from said throttle shaft.

13. A carburetor comprising:

a carburetor body having an intake channel formed therein;

said intake channel defining a free flow cross section;

a throttle flap having a throttle shaft and being pivotally mounted in said carburetor body for controlling said free flow cross section of said intake channel;

said intake channel defining a first longitudinal center axis in the region of said throttle shaft;

said throttle flap having a first end position and a second end position wherein said throttle flap enables a larger flow cross section of said intake channel than in said first end position;

a partition wall section mounted in said intake channel upstream of said throttle shaft;

said partition wall section being configured to partition said intake channel into a mixture channel section and an air channel section;

said throttle flap being configured to lie on said partition wall section when in said second end position thereof;

a choke flap having a choke shaft and being mounted in said intake channel upstream of said partition wall section so as to be pivotal between a first end position and a second end position wherein said choke flap enables a greater flow cross section than in said first end position;

said throttle flap defining a pivot axis;

said intake channel defining a second longitudinal center axis in the region of said choke shaft; and, said first longitudinal center axis and said second longitudinal center axis being at an offset (c) to each other measured parallel to said pivot axis of said throttle flap.

14. The carburetor of claim 13, wherein said offset (c) is at least 1 mm.

15. A two-stroke engine comprising:

a carburetor having a carburetor body;

said carburetor body having an intake channel formed therein;

said intake channel defining a free flow cross section;

a throttle flap having a throttle shaft and being pivotally mounted in said carburetor body for controlling said free flow cross section of said intake channel;

said intake channel defining a first longitudinal center axis in the region of said throttle shaft;

said throttle flap having a first end position and a second end position wherein said throttle flap enables a larger flow cross section of said intake channel than in said first end position;

a partition wall section mounted in said intake channel upstream of said throttle shaft;

said partition wall section being configured to partition said intake channel into a mixture channel section and an air channel section;

said throttle flap being configured to lie on said partition wall section when in said second end position thereof;

a choke flap mounted in said intake channel upstream of said partition wall section so as to be pivotal between a first end position and a second end position wherein said choke flap enables a greater flow cross section than in said first end position;

said throttle flap and said choke flap being mounted so as to mutually overlap in the direction of said first longitudinal center axis when in said respective second end positions thereof;

said two-stroke engine further including an intake channel and said intake channel of said carburetor forming part of said intake channel of said two-stroke engine;

said intake channel of said two-stroke engine being partitioned into a mixture channel and an air channel downstream of said carburetor;

said mixture channel section of said carburetor connecting to said mixture channel downstream of said carburetor;

said air channel section of said carburetor connecting to said air channel downstream of said carburetor;

said two-stroke engine further including a cylinder defining a combustion chamber;

a piston delimiting said carburetor chamber and being mounted so as to carry out a reciprocating movement in said cylinder;

a crankcase;

a crankshaft mounted in said crankcase;

said piston being connected to said crankshaft to rotatably drive said crankshaft;

said crankcase defining a crankcase interior space;

a mixture inlet communicating with said crankcase interior space;

said mixture channel downstream of said carburetor opening into said crankcase interior space via said mixture inlet; and, said two-stroke engine further including at least one transfer channel; and, said air channel downstream of said carburetor being connectable with said at least one transfer channel.

16. A two-stroke engine comprising:

a carburetor having a carburetor body;

said carburetor body having an intake channel formed therein;

said intake channel defining a free flow cross section;

a throttle flap having a throttle shaft and being pivotally mounted in said carburetor body for controlling said free flow cross section of said intake channel;

said intake channel defining a first longitudinal center axis in the region of said throttle shaft;

said throttle flap having a first end position and a second end position wherein said throttle flap enables a larger flow cross section of said intake channel than in said first end position;

a partition wall section mounted in said intake channel upstream of said throttle shaft;

said partition wall section being configured to partition said intake channel into a mixture channel section and an air channel section;

said throttle flap being configured to lie on said partition wall section when in said second end position thereof;

a choke flap having a choke shaft and being mounted in said intake channel upstream of said partition wall section so as to be pivotal between a first end position and a second end position wherein said choke flap enables a greater flow cross section than in said first end position;

said throttle flap defining a pivot axis;

said intake channel defining a second longitudinal center axis in the region of said choke shaft;

said first longitudinal center axis and said second longitudinal center axis being at an offset (c) to each other measured parallel to said pivot axis of said throttle flap;

said two-stroke engine further including an intake channel and said intake channel of said carburetor forming part of said intake channel of said two-stroke engine;

said intake channel of said two-stroke engine being partitioned into a mixture channel and an air channel downstream of said carburetor;

said mixture channel section of said carburetor connecting to said mixture channel downstream of said carburetor;

said air channel section of said carburetor connecting to said air channel downstream of said carburetor;

said two-stroke engine further including a cylinder defining a combustion chamber;

a piston delimiting said combustion chamber and being mounted so as to carry out a reciprocating movement in said cylinder;

a crankcase;

a crankshaft mounted in said crankcase;

said piston being connected to said crankshaft to rotatably drive said crankshaft;

said crankcase defining a crankcase interior space;

a mixture inlet communicating with said crankcase interior space;

said mixture channel downstream of said carburetor opening into said crankcase interior space via said mixture inlet; and, said two-stroke engine further including at least one transfer channel; and, said air channel downstream of said carburetor being connectable with said at least one transfer channel.

* * * * *